US011641895B2

(12) United States Patent
Torano

(10) Patent No.: US 11,641,895 B2
(45) **Date of Patent: *May 9, 2023**

(54) REVERSIBLE NECKLINE SHAPEWEAR GARMENTS

(71) Applicant: Spanx, LLC, Atlanta, GA (US)

(72) Inventor: Deneb Torano, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/521,165

(22) Filed: Nov. 8, 2021

(65) Prior Publication Data

US 2022/0053853 A1 Feb. 24, 2022

Related U.S. Application Data

(63) Continuation of application No. 16/661,298, filed on Oct. 23, 2019, now Pat. No. 11,166,501.

(60) Provisional application No. 62/750,501, filed on Oct. 25, 2018.

(51) Int. Cl.

| | |
|---|---|
| ***A41D 15/00*** | (2006.01) |
| ***A41B 9/10*** | (2006.01) |
| ***A41H 43/02*** | (2006.01) |

(52) U.S. Cl.

CPC ..... *A41D 15/005* (2013.01); *A41B 9/10* (2013.01); *A41H 43/02* (2013.01)

(58) Field of Classification Search

CPC ..... A41D 15/005; A41B 9/10; A41H 43/02

See application file for complete search history.

(56) References Cited

U.S. PATENT DOCUMENTS

| | | | | |
|---|---|---|---|---|
| 4,625,338 | A | 12/1986 | Starling | |
| 5,772,492 | A | 6/1998 | Erwin | |
| 6,113,460 | A | 9/2000 | McKeown | |
| D577,877 | S | 10/2008 | Saincome-Vawler | |
| D637,790 | S | 5/2011 | Stoffle | |
| 8,256,027 | B2 | 9/2012 | Pedersen | |
| D683,929 | S | 6/2013 | Bryan | |
| 8,574,025 | B2 | 11/2013 | Kent | |
| 8,650,662 | B2 | 2/2014 | Decker | |
| 8,864,551 | B2 | 10/2014 | Melarti | |
| D731,744 | S * | 6/2015 | Coburn | D2/703 |
| D739,118 | S | 9/2015 | Aitch | |
| D789,654 | S | 6/2017 | Aitch | |
| 10,080,389 | B2 | 9/2018 | Melarti | |
| 10,285,461 | B2 | 5/2019 | Hanson Allen et al. | |
| 11,166,501 | B2 * | 11/2021 | Torano | A41H 43/02 |
| 2010/0199403 | A1 | 8/2010 | Greenblat | |

(Continued)

*Primary Examiner* — Gloria M Hale

(74) *Attorney, Agent, or Firm* — Meunier Carlin & Curfman LLC

(57) ABSTRACT

Disclosed herein is a reversible neckline shapewear garment that can be worn forwards or backwards, depending on the wearer's preference. The reversible shapewear garment described herein includes two necklines, wherein the first neckline may extend under the wearer's breasts and the second neckline may extend across or above the wearer's breasts. Advantageously, this reversible garment may be worn backwards or forwards by the wearer while contouring to the natural body without creating visible lines or bulges of fabric or losing shape. Also disclosed herein are methods of assembling and wearing the reversible neckline shapewear garment.

15 Claims, 5 Drawing Sheets

(56) References Cited

U.S. PATENT DOCUMENTS

| | | | | |
|---|---|---|---|---|
| 2014/0352026 | A1* | 12/2014 | Greenblat | A41D 27/02 2/69 |
| 2016/0015091 | A1 | 1/2016 | Hendrickson | |
| 2016/0021940 | A1 | 1/2016 | Carney | |

* cited by examiner

REVERSIBLE NECKLINE SHAPEWEAR GARMENTS

CROSS-REFERENCE TO RELATED APPLICATIONS

This application is a United States Non-Provisional Application, which is a continuation application of U.S. patent application Ser. No. 16/661,298, filed on Oct. 23, 2019, now U.S. Pat. No. 11,166,501, granted Nov. 9, 2021, which claims the benefit of U.S. Provisional Application No. 62/750,501, filed Oct. 25, 2018, the contents of which are hereby incorporated herein by reference in their entirety for all purposes.

BACKGROUND

A slip is an undergarment worn beneath a dress or skirt to help it hang smoothly and to prevent chafing of the skin from coarse fabrics. Slips are also worn for warmth, and to protect fine fabrics from perspiration. Slips can also be used to prevent undergarments from showing through, or for preventing the silhouette of the legs showing through clothing when standing in front of a bright light source. If these benefits are only needed for the upper body, a tank top or camisole can be used instead. A full slip hangs from the shoulders, with the body of the slip extending from above the breast down to the thighs or farther. A tank top or camisole hangs from the shoulders, but with the body of the garment covering only the upper body.

SUMMARY

A reversible shapewear garment is disclosed herein that includes a first side having a first neckline that extends under the wearer's breasts, and a second side having a second neckline that extends across or above the wearer's breasts. In some embodiments, the top edge of the first neckline extends toward a vertical center line of the garment at a first point and the top edge of the second neckline extends toward a vertical center line of the second side at a second point that is superiorly located in relation to the second point. The reversible shapewear garment comprises an upper region and a lower region. The reversible shapewear garment disclosed herein may include a shirt, a camisole, a bustier, a midriff tank top, a long tank top, or a slip. Additionally, in some embodiments, the first neckline may be a scoop neck neckline or a V-neck neckline.

In some embodiments, the upper region has a first panel, a second panel, and a third panel. The first panel and the second panel of the first side at least partially define the first neckline, and the third panel of the second side at least partially defines the second neckline. The first panel can be attached to the lower region of the first side along a first distance and the second panel can be attached to the lower region of the first side along a second distance. The third panel can be attached to the lower region of the second side along a third distance that is greater than the first distance and the second distance.

In some embodiments, the upper region of the second side also includes a fourth panel that further at least partially defines the second neckline. The first panel can be attached to the lower region of the first side along a first distance and the second panel can be attached to the lower region of the first side along a second distance. The third panel can be attached to the lower region of the second side along a third distance and the fourth panel can be attached to the lower region of the second side along a fourth distance. The third and fourth distances are greater than the first and second distances.

In some embodiments, the lower region of the first side and second side are formed of a first material, and the first, second, third, and fourth panels are formed of a second material that is different than the first material. In some embodiments, the second material is a mesh material comprising from 1% to 25% elastane.

In some embodiments, the lateral edge of the first panel and the lateral edge of the fourth panel at least partially overlap beneath a first arm space, and the lateral edge of the second panel and the lateral edge of the third panel at least partially overlap beneath a second arm space. In some embodiments, the lateral edge of the first panel is fixedly attached along a lateral edge of the fourth panel beneath a first arm space and a lateral edge of the second panel is fixedly attached along a lateral edge of the third panel beneath a second arm space. In some embodiments, an elastic band is attached along a superior edge of the lower region on the first and second sides of the shapewear garment. The first, second, third, and fourth panels of the upper region can be attached to the elastic band.

Methods of making a reversible shapewear garment having a first and second side are disclosed herein. Methods of making the undergarment can include the step of providing a first fabric, and cutting a first, second, and third panel from the first fabric. The method can include attaching the first and second panels to a superior edge of a first side of a provided tubular lower region such that the first and second panels at least partially define a first neckline configured to extend under a wearer's breasts. A third panel can be attached to a superior edge of the second side of the provided tubular lower region such that the third panel at least partially defines a second neckline configured to extend across or above a wearer's breasts. The method can further include attaching a superior edge of the third panel to a superior edge of the second panel, or attaching a superior edge of the third panel to superior edges of both the first and second panels.

In some embodiments, the method further includes the step of cutting a fourth panel from the first fabric and attaching the fourth panel to the superior edge of the second side of the provided tubular lower region. The method can include attaching a superior edge of the fourth panel to the superior edge of the first panel, such that the third and fourth panels at least partially define the second neckline. The method can further include fixedly attaching the first panel to the fourth panel at a first lateral seam or attachment beneath a first arm space, and attaching the second panel to the third panel at a second lateral seam or attachment beneath a second arm space. In some embodiments, the method includes overlapping the lateral edge of the first panel with the lateral edge of the fourth panel beneath a first arm space, and overlapping the lateral edge of the second panel with the lateral edge of the fourth panel beneath a second arm space.

DETAILED DESCRIPTION

Figure 1:
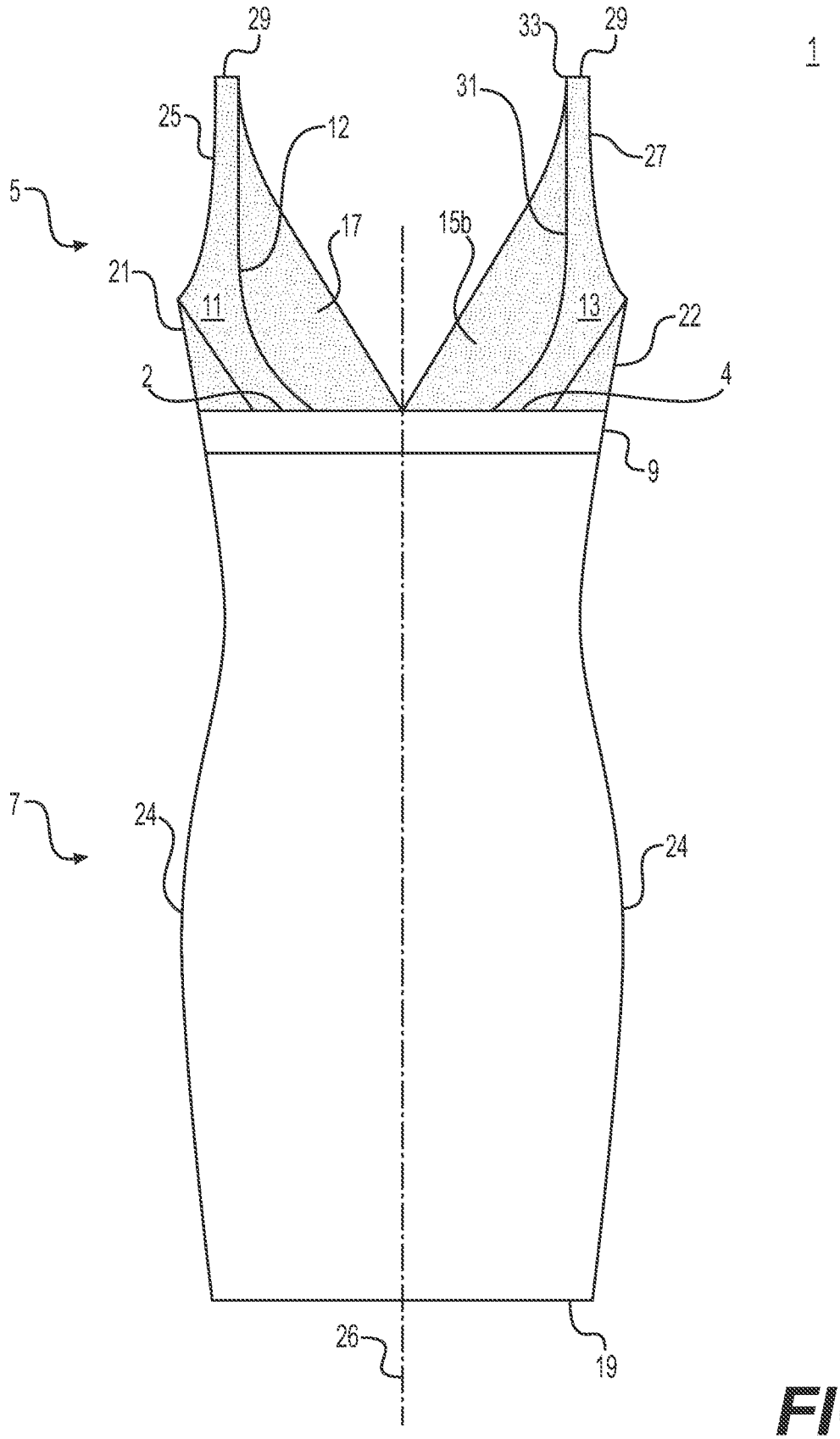
FIG. 1 is a front view of an embodiment of a reversible neckline shapewear garment.

It is often desirable to wear undergarments that provide shaping compression, fit comfortably, and cannot be seen once the outerwear is in place. Reversible undergarments are available that provide the wearer with two neckline options. This reduces the chance that the undergarment will be seen since the neckline of the undergarment can be matched to the neckline of the outerwear. However, conventional reversible undergarments lack versatility because the necklines are relatively high on both sides. Furthermore, they do not provide shaping to the wearer, nor do they anchor to the body. The loose fit can cause uncomfortable and unsightly bunching to occur. The reversible shapewear garments disclosed herein address the limitations of conventional reversible undergarments by providing a compressive, shaping garment with an open-bust neckline on one side. Open-bust necklines are desirable because they are below the breasts, limiting the chance they will be seen once the outerwear is in place. Furthermore, they add functionality because the side with the higher neckline can function as a brassiere, whereas the neckline on the open-bust side can be positioned underneath a separate brassiere of the wearer's choosing. As an additional benefit, the compressive, shaping nature of the garment prevents unsightly and uncomfortable bunching.

As used herein, the words "inferior" and "superior" are anatomical terms used to describe the position relative to the wearer's head. "Inferior" is farther from the head, and "superior" is closer to the head. For example, if a first point is inferiorly located in relation to a second point, the first point is farther from the wearer's head than the second point when the garment is being worn as intended. The term "beneath" indicates an inferior position. The term "above" indicates a superior position.

As used herein, the words "medial" and "lateral" are anatomical terms used to describe the position relative to the wearers sides. "Lateral" is closer to the sides, and "medial" is farther from the sides (closer to the wearer's vertical center line).

As used herein, "fixedly attached" is defined as attached via sewing, bonding, or any other type of attachment that secures two edges in a permanent fashion. Seamlessly attached is defined as continuously formed as one stretch of fabric. Seamless attachment can be achieved by knitting two or more portions, regions, or panels of the undergarment together as one piece of fabric, such that there is no seam joining the portions. This can be achieved by using a seamless knitting machine, a hosiery machine, or other knitting machine. Seamless attachment can also be done by continuously forming two or more portions or panels as one stretch of woven or non-woven fabric.

Further, in some embodiments, the panels of the upper region are fixedly attached creating a side seam. In other embodiments, the panels of the upper region are fixedly attached to an elastic band attached along a superior edge of the lower region, wherein the inferior edges of the panels are attached to the elastic band.

Figure 2:
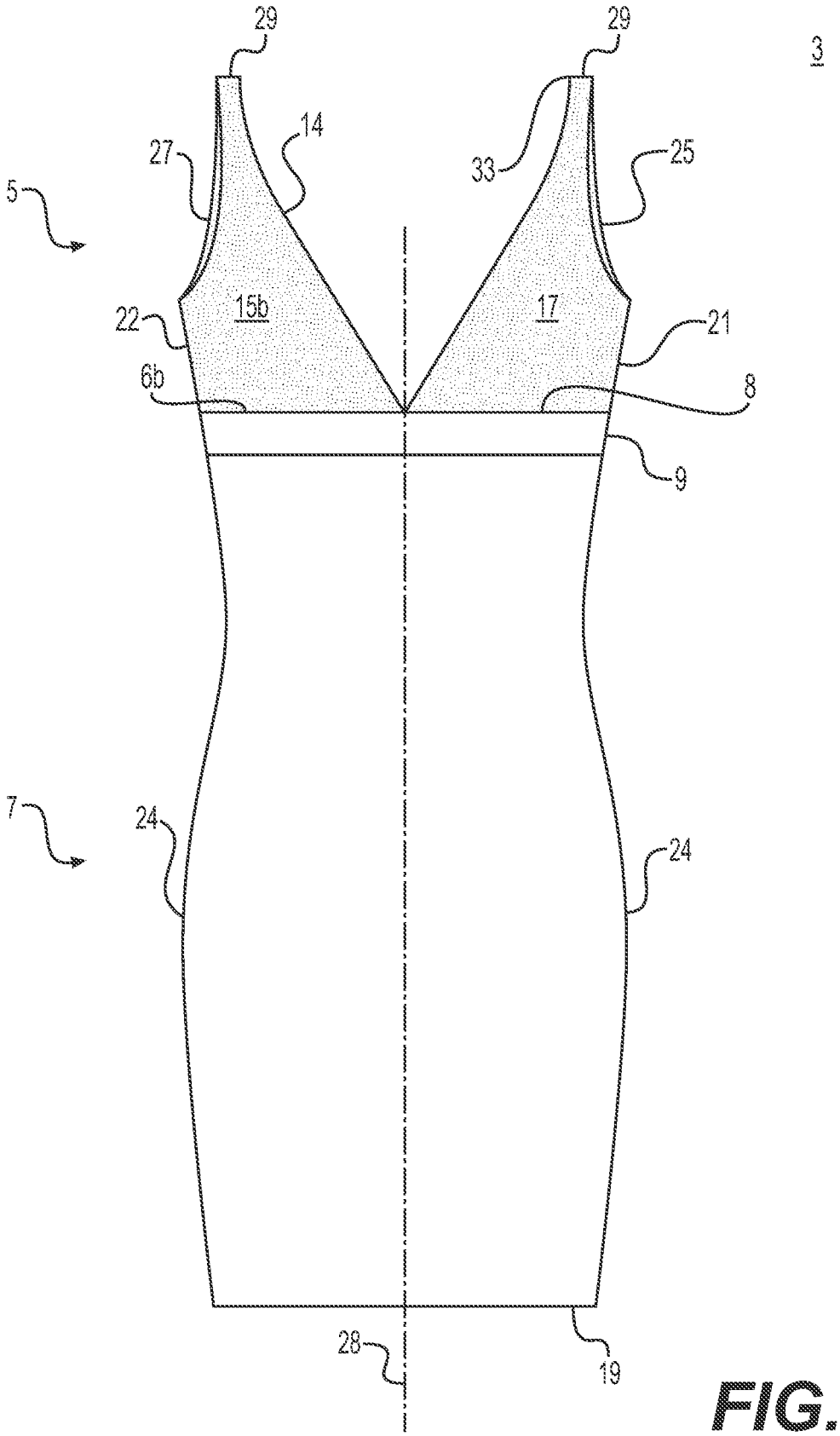
FIG. 2 is a rear view of the embodiment of the reversible neckline shapewear garment shown in FIG. 1.

The disclosed reversible shapewear garment includes a first side 1 and a second side 3. FIG. 1 illustrates a front view of the first side 1 of a reversible neckline shapewear garment embodiment having a having an upper region 5 and a lower region 7. FIG. 2 illustrates a rear view of the embodiment of the reversible neckline shapewear garment shown in FIG. 1 having a second side 3. FIGS. 1 and 2 illustrate one embodiment, and are not intended to be limiting. In other embodiments, the reversible shapewear garment may include a shirt, camisole, bustier, midriff tank top, long tank top, slip, or any other similar garment.

Figure 5:
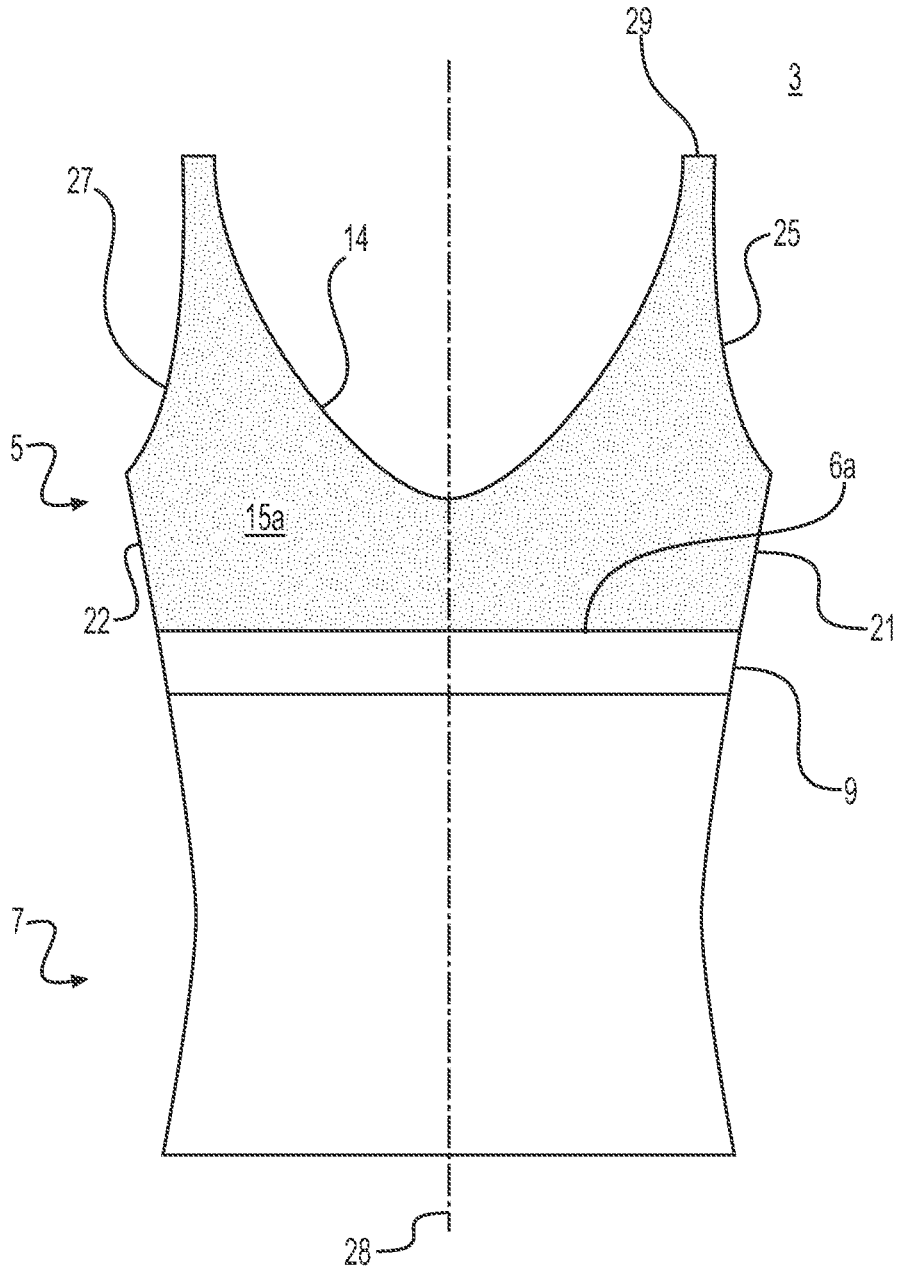
FIG. 5 is a front view of an embodiment of a reversible neckline shapewear garment.

The upper region of the garment can have a first panel 11 and a second panel 13 on a first side 1 of the garment, as shown in FIG. 1, which together define the first neckline 12 that extends under a wearer's breasts. Specifically, a medial edge of the first panel 11 and a medial edge of the second panel 13 define the first neckline 12. The neckline 14 on the second side 3 of the garment may take the shape of a scoop neck, a V-neck, a plunging neckline, or any other necklines that are configured to extend across or over the breasts. An example of a scoop neck neckline is illustrated in FIG. 5. The upper region 5 of the scoop neck embodiment has three panels; two panels 11, 13, on the first side 1 and one panel 15*a* on the second side 3. The superior edge of the third panel 15*a* defines second neckline 14. An example of a V-neck embodiment is shown in FIG. 2. The upper region 5 of the V-neck embodiment has four panels; two panels 11, 13 on the first side 1 and two panels 15*b*, 17 on the second side 3. The medial edge of the third panel 15*b* and the medial edge of the fourth panel 17 define the second neckline 14. The embodiments of the depicted necklines in FIG. 2 and FIG. 5 are not intended to be limiting.

The disclosed undergarment has a first neckline 12 configured to extend under a wearer's breasts (open-bust) and a second neckline 14 configured to extend across or above the wearer's breasts (closed-bust). In some embodiments, such as those shown in FIGS. 1-5, the top edge of the first neckline 12 begins to extend medially towards a vertical center line 26 of the first side 1 at a first point 31 and the top edge of the second neckline 14 begins to extend medially towards a vertical center line 28 of the second side 3 at a second point 33. The first point 31 is inferiorly located in relation to the second point 33. The inferior location of the first point 31 provides for the first neckline 12 to be worn forwards under the wearer's breasts, or for the first neckline 12 to be worn backwards providing a low-back option for the wearer.

In some embodiments, the reversible shapewear garment includes a lower region 7. The lower region 7 of the first side 1 and the lower region 7 of the second side 3 can be formed as separate panels fabric that are attached along a lateral seam 24 by sewing, bonding, or other attachment method known in the art, creating a tubular lower region 7. In other embodiments, the lower region 7 of the first side 1 and the lower region 7 of the second side 3 are formed continuously of the same fabric, creating a seamless tubular lower region 7.

In some embodiments, the lower region 7 of the first side 1 and lower region 7 of the second side 3 are formed of a first material, and the upper region 5 of the first side 1 and upper region 5 of the second side 3 are formed of a second material different from the first material. In some embodiments, the second material can be made of any stretchable fabric, including the same kind of fabric as the first material of the lower region 7. In some embodiments, the first material of the lower region 7 can include any fabric known in the art for use in undergarments or shapewear, including but not limited to, nylon, cotton, elastane, polyester, modal, rayon, linen, other fabrics, or any combinations thereof. In some embodiments, the second material of the upper region 5 can include any fabric known in the art for use in undergarments or shapewear, including but not limited to nylon, cotton, elastane, polyester, modal, rayon, linen, other fabrics, or any combinations thereof. In some embodiments, the fabric of the upper region is a flexible mesh material that contains from 1% to 25% elastane. The flexible mesh of the upper region permits the first panel 11, the second 13, the third panel 15*a* or 15*b*, and the fourth panel 17 to flex and conform to the wearer's breasts or the wearer's back, regardless of which side is being worn in front. The material helps to provide fit and structure without creating undesired bunching or bulging.

In some embodiments, the material used to form the upper region panels of the first side 1 can be different than material used to form the upper region panel(s) of second side 3. In some embodiments, the material used to form the first side of the lower region 7 can be different from the material used to form the second side of the lower region 7.

As shown in FIG. 1, the first panel 11 can be fixedly attached to the lower region 7 of the first side 1 along a first distance 2. The second panel 13 can be fixedly attached to the lower region 7 of the first side 1 along a second distance 4. In some embodiments, such as the one shown in FIG. 5, the third panel 15*a* is fixedly attached to the lower region 7 of the second side 3 along a third distance 6*a*, wherein the third distance 6*a* is greater than the first distance 2 and the second distance 4. In some embodiments, such as the one shown in FIG. 2, the third panel 15*b* is fixedly attached to the lower region 7 along a third distance 6*b* and the fourth panel 17 is fixedly attached to the lower region 7 along a fourth distance 8, wherein the third distance 6*b* and the fourth distance 8 are greater than the first distance 2 and the second distance 4. The shorter distances 2 and 4 as illustrated in FIG. 1 provide for the open-bust neckline configuration 12, wherein the first neckline 12 is configured to be worn under the wearer's breasts.

The lower region of the disclosed reversible shapewear garment can optionally include an elastic band 9, as shown in FIGS. 1 and 2. The elastic band 9 is fixedly attached along a superior edge of the lower region 7 of the first side 1 and a superior edge of the lower region 7 of the second side 3. In some embodiments, the inferior edges of the first panel 11, the second panel 13, the third panel 15*a* or 15*b*, and the fourth panel 17 are fixedly attached to the elastic band 9. The attachment of the panels to the elastic band anchors the upper region 5 to the lower region 7, contouring the upper region to the wearer's body. However, it is to be understood that some embodiments may not include an elastic band, and that panels of the upper region can be attached directly to the fabric of the lower region.

In some embodiments, the upper region 5 of the first side 1 and the upper region 5 of the second side 3 are attached at the shoulder region with a seam, bonding, or other shoulder region attachment 29 known in the art, as shown in FIGS. 1 and 2. For example, in embodiments with a single panel on the second side 3 of the upper region 5, such as the one shown in FIG. 5, superior edge of the third panel 15*a* can be attached to the superior edges of both the first panel 11 and the second panel 13 of the first side 1 at the shoulder region attachment 29. Or, in embodiments with two panels on the upper region 5 of the second side 3, the superior edge of the first panel 11 can be attached to the superior edge of the fourth panel 17 at the shoulder region attachment 29, and the superior edge of the third panel 15*b* can be attached to the superior edge of the second panel 13 at the shoulder region attachment 29. In other embodiments, the upper region 5 of the first side 1 and the upper region 5 of the second side 3 are formed continuously from the same piece of fabric. This configuration along the superior region of the wearer's shoulder is not intended to be limited to the embodiment illustrated in FIGS. 1 and 2. The garment may include a spaghetti strap, a short sleeve, a long sleeve, a tank top, any similar shoulder strap configuration, or a combination thereof.

Figure 3A:
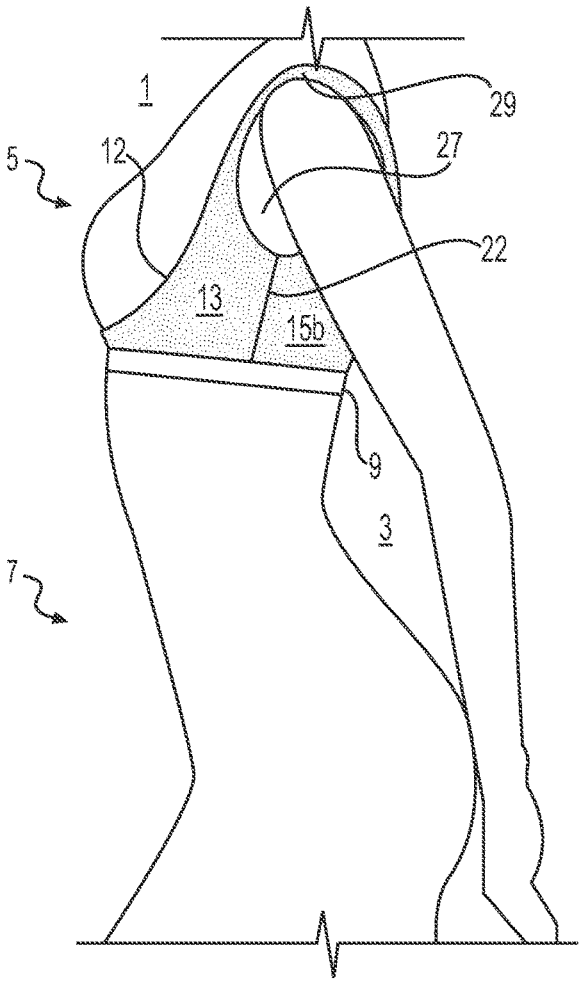
FIG. 3*a* is a first side view of an embodiment of the reversible neckline shapewear garment.
Figure 3B:
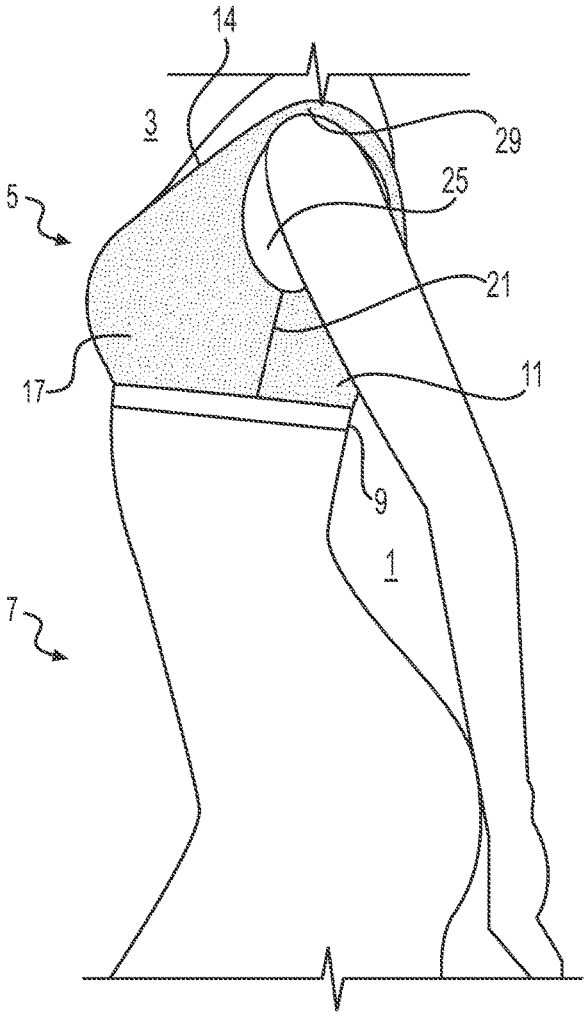
FIG. 3*b* is a second side view of the embodiment shown in FIG. 3*a*.

In certain embodiments, the first arm space 25 and the second arm space 27 are formed by the joining of the panels at lateral seams or attachments 21, 22, as illustrated in FIG. 3*a* and FIG. 3*b*. The second panel 13 and third panel 15*b* are fixedly attached along a second lateral seam or attachment 22 (as shown in FIG. 3*a*), and the first panel 11 and fourth panel 17 are fixedly attached along a first lateral seam or attachment 21 (as shown in FIG. 3*b*). In other embodiments (such as the embodiment of FIG. 5), the first panel 11 and the third panel 15*a* are fixedly attached along a first lateral seam or attachment 21 and the second panel 13 and third panel 15*a* are attached along a second lateral seam or attachment 22.

Figure 4A:
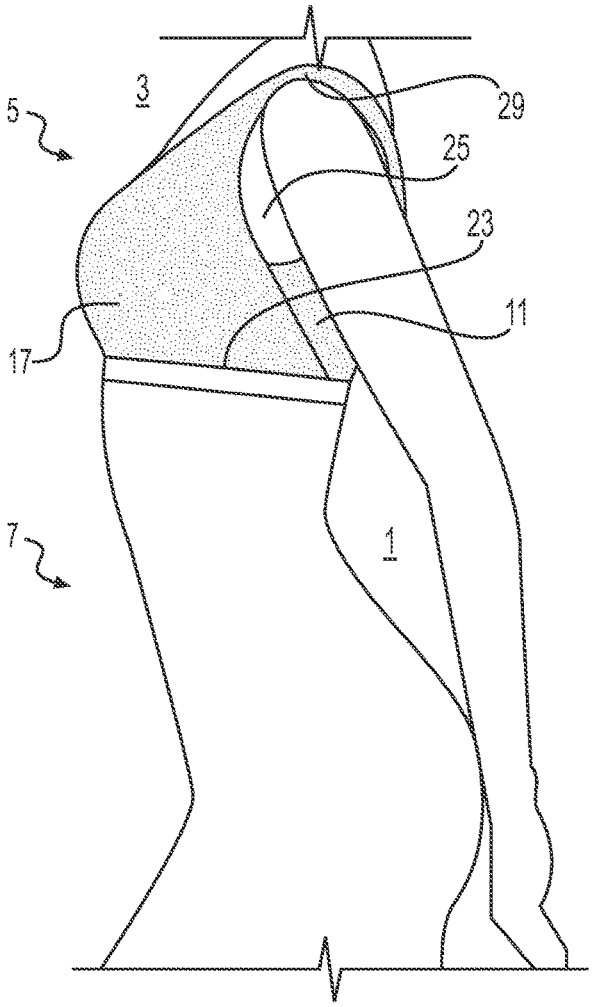
FIG. 4*a* is a first side view of an embodiment of the reversible neckline shapewear garment.
Figure 4B:
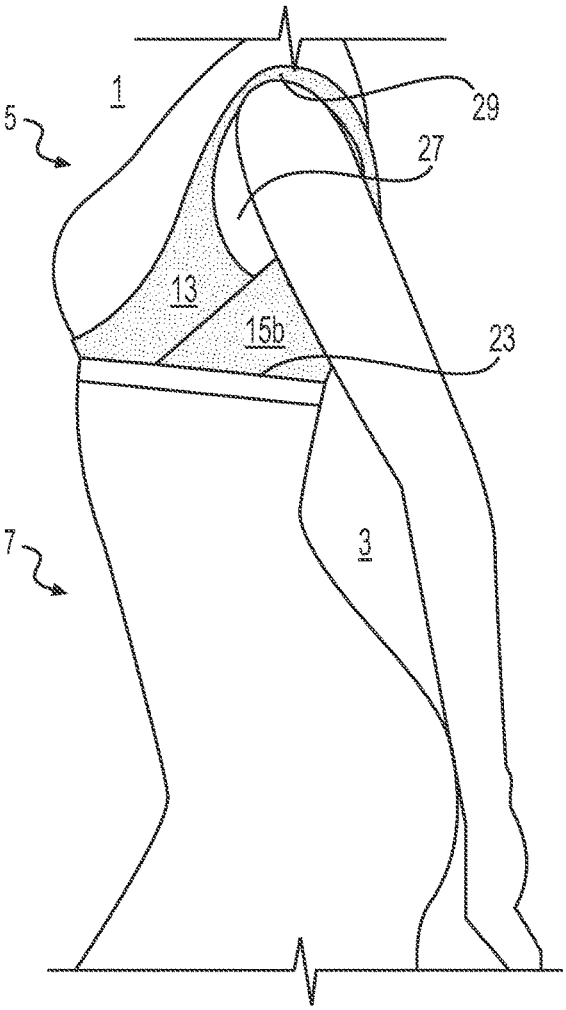
FIG. 4*b* is a second side view of the embodiment shown in FIG. 4*a*.

In certain embodiments, the front and back panels overlap at their lateral edges, as illustrated in FIG. 4*a* and FIG. 4*b*. The lateral edge of the first panel 11 and the lateral edge of the fourth panel 17 at least partially overlap beneath the first arm space 25 (as shown in FIG. 4*a*), and the lateral edge of the second panel 13 and the lateral edge of the third panel 15*b* at least partially overlap beneath the second arm space 27 (as shown in FIG. 4*b*). For the embodiment illustrated in FIG. 5, the lateral edge of the second panel 13 and a lateral edge of the third panel 15*a* at least partially overlap defining the second arm space 27, and the lateral edge of the first panel 11 and a lateral edge of the third panel 15*a* at least partially overlap defining the first arm space 25. The overlapping edge 23 anchors the upper region 5 of the first side 1 to the lower region 7 of the second side 3. The overlapping edge 23 also anchors the upper region 5 of the second side 3 to the lower region 7 of the first side 1. This anchoring may be accomplished by sewing or bonding or other methods of attachment know in the art.

Also disclosed herein is a method of making a reversible shapewear garment having a first neckline and a second neckline. A method of making a reversible shapewear garment includes the steps of providing a first fabric, cutting a first, second, and third panel from the first fabric, and attaching the first and second panels to a superior edge of a first side of a provided tubular lower region such that the first and second panels define a first neckline configured to extend under a wearer's breasts. The method further includes attaching a third panel to a superior edge of the second side of the tubular lower region such that the superior edge of the third panel at least partially defines a second neckline configured to extend across or above a wearer's breasts. In some embodiments, the method further includes attaching a superior edge of the third panel to a superior edge of the second panel, or to both superior edges of the first and second panels.

In certain embodiments, the method further includes cutting a fourth panel from the provided first fabric, attaching the fourth panel to the superior edge of the second side of the tubular lower region, and attaching a superior edge of the fourth panel to the superior edge of the first panel, such that the third and fourth panels define the second neckline. In certain embodiments, the method further includes attaching the first panel to the fourth panel at a first lateral seam, and attaching the second panel to the third panel at a second lateral seam. In certain embodiments, the method further includes overlapping the lateral edge of the first panel with the lateral edge of the fourth panel, and overlapping the lateral edge of the second panel with the lateral edge of the fourth panel.

The invention claimed is:

1. A reversible shapewear garment comprising:

a first neckline on a first side of the reversible shapewear garment, wherein the first side comprises a first panel and a second panel, and wherein the first and the second panels at least partially define the first neckline, and wherein the first neckline is an open-bust neckline configured to extend under a wearer's breasts;

a second neckline on a second side of the reversible shapewear garment, wherein the second side comprises a third panel, and wherein the third panel at least partially defines the second neckline; and wherein the second neckline is configured to extend across or above a wearer's breasts.

2. A reversible shapewear garment comprising:

a first neckline on a first side of the reversible shapewear garment, wherein the first side comprises a first panel and a second panel, and wherein the first and the second panels at least partially define the first neckline, and wherein the first neckline is configured to extend under a wearer's breasts;

a second neckline on a second side of the reversible shapewear garment, wherein the second side comprises a third panel and a fourth panel, and wherein the third and the fourth panels at least partially define the second neckline; and wherein the first neckline and the second neckline are configured to extend across or above a wearer's breasts.

3. The reversible shapewear garment of claim 2, wherein the first panel, the second panel, the third panel, and/or the fourth panel comprise a mesh material comprising from 1% to 25% elastane.

4. The reversible shapewear garment of claim 1, wherein the second neckline is a scoop neck neckline.

5. The reversible shapewear garment of claim 1, wherein the second neckline is a V-neck neckline.

6. The reversible shapewear garment of claim 2, wherein a lateral edge of the first panel and a lateral edge of the fourth panel at least partially overlap beneath a first arm space; and wherein a lateral edge of the second panel and a lateral edge of the third panel at least partially overlap beneath a second arm space.

7. The reversible shapewear garment of claim 2, wherein a lateral edge of the first panel is fixedly attached along a lateral edge of the fourth panel, and wherein a lateral edge of the second panel is fixedly attached along a lateral edge of the third panel.

8. The reversible shapewear garment of claim 2, further comprising an elastic band, wherein a superior edge of the elastic band is attached to inferior edges of the first panel, second panel, third panel, and/or fourth panel, if present.

9. The reversible shapewear garment of claim 1, further comprising a lower region attached to the first panel along a first distance, to the second panel along a second distance, and to the third panel along a third distance, wherein the third distance is greater than the first distance and the second distance.

10. The reversible shapewear garment of claim 8, further comprising a lower region attached to an inferior edge of the elastic band.

11. The reversible shapewear garment of claim 9, wherein the lower region is tubular.

12. The reversible shapewear garment of claim 9, wherein the lower region comprises a material different from the material of the first, second, third, and/or fourth panel if present.

13. The reversible shapewear garment of claim 10, wherein the lower region is tubular.

14. The reversible shapewear garment of claim 10, wherein the lower region comprises a material different from the material of the first, second, third, and/or fourth panel if present.

15. The garment of claim 1, wherein the garment is a shirt, a camisole, a bustier, a halter tank top, a long tank top, or a slip.

* * * * *